United States Patent [19]

Cummings

[11] 4,037,304

[45] July 26, 1977

[54] METHOD OF REMOVING RODS FROM METALLIC ANODES

[75] Inventor: Thomas L. Cummings, Ocoee, Tenn.

[73] Assignee: Olin Corporation, New Haven, Conn.

[21] Appl. No.: 699,552

[22] Filed: June 24, 1976

[51] Int. Cl.[2] ..... B23P 19/00

[52] U.S. Cl. ..... 29/427; 408/1 R

[58] Field of Search ..... 29/427, 426, 401 R, 29/401 B, 401 E, 401 F, 402, 403; 408/1 R; 29/200 D, 200 R; 204/207, 208, 209

[56] References Cited

U.S. PATENT DOCUMENTS

| | | | |
|---|---|---|---|
| 1,952,025 | 3/1934 | Witte | 29/427 |
| 2,237,570 | 4/1941 | Maillart | 29/401 R |
| 2,897,585 | 8/1959 | Bodewein | 29/401 F |
| 3,180,018 | 4/1965 | Hougen | 408/1 |
| 3,204,492 | 9/1965 | Spreen | 408/1 |

*Primary Examiner*—Milton S. Mehr

*Attorney, Agent, or Firm*—Bruce E. Burdick; Donald F. Clements; Thomas P. O'Day

[57] ABSTRACT

A method of removing a portion of a rod from a metallic anode of the type used in chlor-alkali electrolytic cells. The anode is of the type having a foraminous surface comprised of a plurality of closely spaced substantially parallel rods with the rods being welded to a supporting structure at at least two locations. The method comprises mounting a drill bit in a drill so that no more than about 0.250 inch of the free end of the drill bit extends unsupported from the chuck. The rotating drill bit is advanced through the wire to be removed at at least two locations, with the rod free of weldings between the two locations. The portion of the rod may then be removed for testing or other purposes.

6 Claims, 4 Drawing Figures

METHOD OF REMOVING RODS FROM METALLIC ANODES

Figure 4:
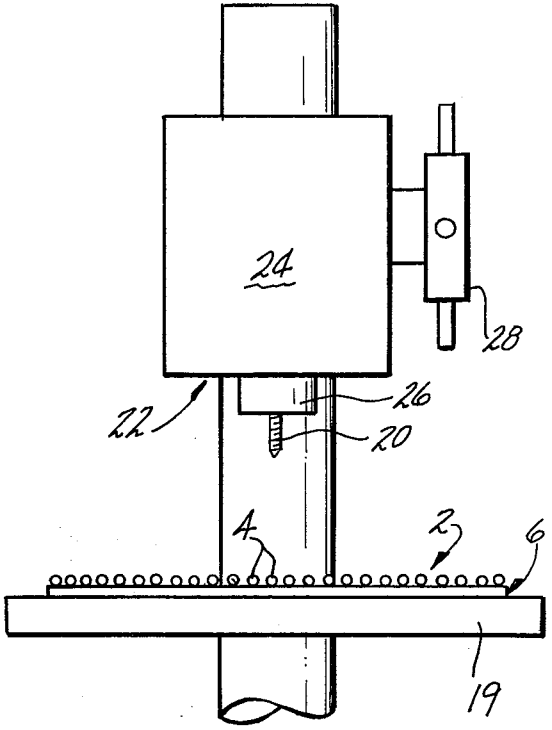

The present invention relates to a method for removing a portion of a rod of a metallic anodic surface. More particularly, the present invention relates to the utilization of a drill for removing rods from such anodic surfaces.

In the operation of electrolytic cells, employing a mercury amalgam cathode in the production of chlorine, the conventional graphite anodes are gradually being replaced by metal anodes of various designs and compositions. Generally, these metal anode designs including a distributor having at least one anode post secured to the top thereof for supplying electrolytic current to the distributor. The distributor can be generally in the form of an inverted channel having a web with two legs extending downwardly therefrom. A foraminous anodic surface is secured to the bottom of the two legs of the distributor in electric contact with each of the legs. Various materials are used in fabricating the foraminous anodic surface. For example, the surface can be a metallic base such as titanium, niobium, tantalum or zirconium which is coated with at least one oxide of a platinum metal such as ruthenium, palladium, iridium, rhodium, osmium and mixtures thereof. In addition, other materials are currently being tested and tried for use as anodic surfaces.

In one form, the anodic surface can comprise a plurality of closely spaced, substantially parallel rods with the rods being welded to a support structure at at least two locations. With such an anodic surface, it is sometimes desirable to remove a portion of the rods for test purposes. For example, the removed portion of the rod can be tested as an anode in a small bench scale electrolytic cell or may be subjected to microphotographed to ascertain the condition of the coating. Prior to the present invention, the rods were usually removed by either chiseling or with a hacksaw. However, not only was this time consuming, but also adjacent rods on the anode were sometimes damaged, rendering the remaining anodic surface substantially inoperable. In addition, the removed rod was sometimes damaged by bending or torquing of the rod during its removal.

In view of the above, it is an object of the present invention to provide an improved method of removing a portion of a rod of a foraminous metallic anode.

A more specific object of the present invention is the provision of a method for removing a rod from a metallic anode in which the chance of damage to an adjacent rod is substantially lessened, and whereby the time required for removal of the portion of the rod is decreased.

These and other objects and advantages of the present invention can be achieved according to a preferred embodiment of this invention by inserting a drill into a drill bit so that no more than about 0.250 inch of the free end of the drill bit extends unsupported from the chuck of the drill. The rotating drill bit is then advanced through the wire to be removed in at least two locations with the wire being free of weldments between the locations and the portion of the wire then removed.

Figure 1:
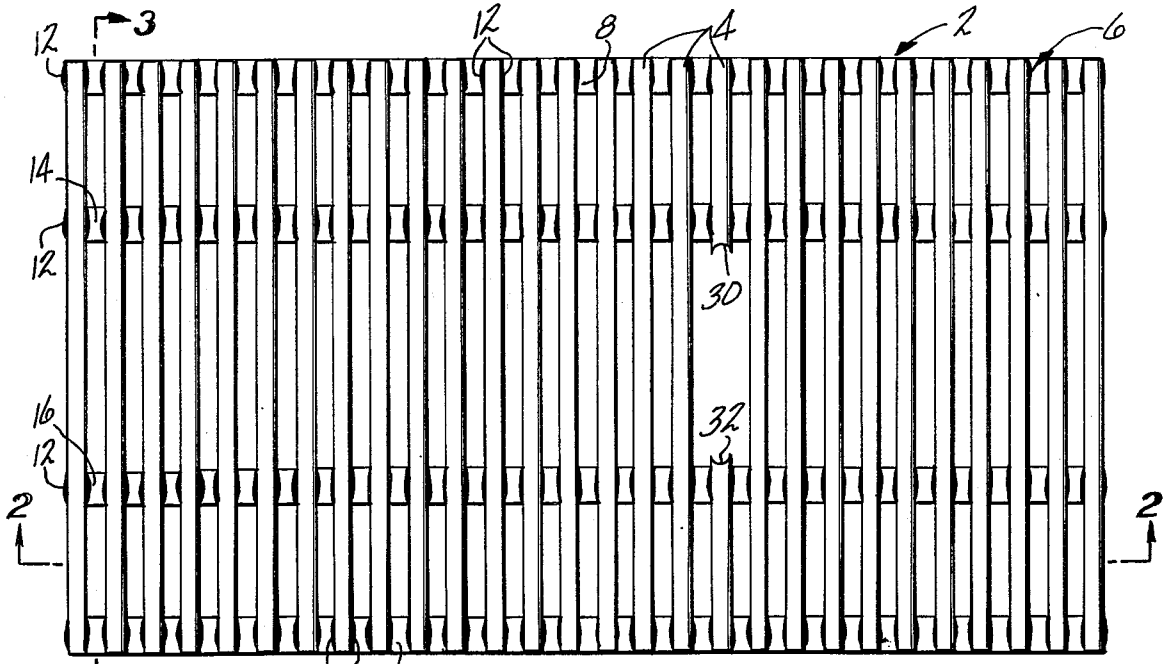
Figure 2:
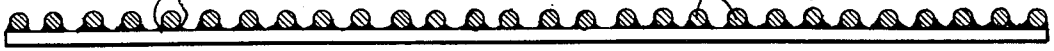
Figure 3:
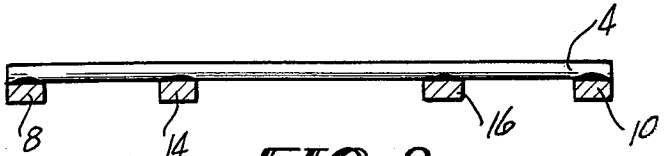

The present invention can be better understood by reference to the following description and to the accompanied drawings in which:

FIG. 1 is a bottom view of an anodic surface wherein a portion of one of the rods has been removed, FIG. 2 is a sectional view taken along the lines of FIG. 2—2 of FIG. 1, FIG. 3 is a sectional view taken along the lines 3—3 of FIG. 1; and FIG. 4 shows the anodic surface mounted on a drill press in a position to have the portion of one of the rods removed.

FIG. 1 shows a foraminous anodic surface 2 having a structure to which the method of the present invention is especially applicable. The anodic surface 2 comprises a plurality of elongated rod members 4 attached to a supporting structure 6.

The supporting structure 6 can include elongated strip members 8 and 10 which extend generally perpendicular to the rod members 4 and are attached to opposite end portions of the rod members 4 by weldments as indicated by numeral 12. Additionally, depending upon the length of rod members 4 two intermediate strip members 14 and 16 may be provided in spaced apart relationship and welded to each of the rod members 4.

As described in U.S. Pat. No. 3,912,616 issued Oct. 14, 1975 to J. M. Ford, which is incorporated herein by reference, a channel-shaped distributor member can have its legs connected to the intermediate strip members 8 and 10 and at least one anode post connected to the distributor. However, such distributor and anode post has not been shown herein for the sake of clarity as the present invention is directed to removing the portion of the rod from its supporting surface, and not with the other structure of an anode assembly.

By way of example, the rod members can be 0.125 inch in diameter and be spaced from an adjacent rod member a similar distance. The rod members can comprise a base of a suitable metal such as titanium, niobium, tantalum, or zirconium. The rod members 4 can be coated with at least one oxide of a platinum metal and preferably of a mixture of metal oxides. Typical examples of suitable metal oxides include platinum oxide, ruthenium oxide, iridium oxide, rhodium oxide, palladium oxide and osmium oxide.

The rod members are preferably cylindrical, although they can assume other shapes. For example, the side against the strip members can be flattened, or the rod itself can be oval.

When it is desired to remove a portion of one of the rods 4, the anodic surface can be placed on a suitable surface 19 for contact by a drill bit 20 mounted in a drill press 22. The drill press 22 can be of a conventional design and includes a motor 24 which drives a chuck 26. A crank 28 can be provided for advancing the drill bit 20 toward the anode surface. The drill bit 20 is preferably a high carbon steel drill bit and has a diameter the same or slightly larger than the diameter of the rods 4. In any event, the diameter of the bit 20 should be less than the distance between every third rod.

An important feature of this invention is that the drill bit 20 is foreshortened from its normal length. This can be accomplished either by removing a portion of the shank of the drill bit, or inserting the drill bit 20 into the drill chuck 26 so that a normally smaller portion of the drill bit extends unsupported from the chuck 26. This feature helps avoid the tendency for the drill bit to skip off the surface of a rod 4, preventing proper drilling and possibly damaging an adjacent rod 4. The extent of such "skipping off" can be reduced to a satisfactory level if the drill bit is foreshortened so that no more than about 0.250 inch of the drill bit extends unsupported from the chuck.

The optimal velocity of rotation of the drill bit depends upon the actual type of drill bit used and the particular composition of the rod. For titanium base rods and a high carbon steel drill bit, 900 rpm has been found to be an optimal velocity.

With the drill bit 20 mounted in the chuck 26 so that the bit is foreshortened, the anodic surface 2 can be placed under the drill bit 20 and the location on 20. The anodic surface 2 which is to be drilled is aligned with the drill bit, the drill screw 22 can then be activated and the rotating drill bit advanced through the rod. The rod 4 should be drilled at two locations, with the rod 4 free of weldments between the locations. One location 30 can be immediately inside of strip member 14 and the second location 32 can be immediately inside of strip member 16 as shown in FIG. 1. After the drill bit has been advanced through the rod 4 at two locations, that portion of the wire can be removed.

By virtue of this invention, a portion of a rod of a metallic anode can be removed without danger of damaging adjacent wires. In addition, there is little likelihood of damage to the removed portion of the wire. Further, the time required for removal of the rod is significantly decreased.

What is claimed is:

1. A method of removing a portion of a rod from a metallic anode of the type used in chlor-alkali electrolytic cells without damaging adjacent rods, said anode having a foraminous surface comprised of a plurality of closely spaced, substantially parallel rods, said rods being welded at method comprising a. mounting a drill bit in a chuck with a free end of the drill bit foreshortened to a length no more than twice the diameter of the drill bit so that the drill bit does not skip off the surface of the rod, rotating the drill bit at a suitable speed for drilling said rod;

c. advancing the rotating drill bit through said rod to be removed at at least two separate locations, said rod being free of weldments between said locations, and d. removing the portion of the rod between the two locations.

2. The method of claim 1 wherein the drill bit is mounted so that no more than about 0.250 inch of the drill bit extends unsupported from the chuck.

3. The method of claim 1 wherein said diameter of said drill bit is less than the distance between every third anode and at least as great as the diameter of said rod.

4. The method of claim 1 wherein said rod is cylindrical.

5. The method of claim 1 wherein the rod has a titanium base and said drill bit is high carbon steel.

6. The method of claim 5 wherein the drill is rotated at a speed of about 900 rpm.

* * * * *